United States Patent [19]

Relihan et al.

[11] Patent Number: 4,590,603

[45] Date of Patent: May 20, 1986

[54] AUTOMATIC X-RAY ENTRANCE DOSE COMPENSATION

[75] Inventors: Gary F. Relihan, Nashotah; Joseph J. Grass, Brookfield; Jerry L. Neitzell, Mukwonago, all of Wis.

[73] Assignee: General Electric Company, Schenectady, N.Y.

[21] Appl. No.: 569,179

[22] Filed: Jan. 9, 1984

[51] Int. Cl.[4] ..... H05G 1/44; H05G 1/34

[52] U.S. Cl. ..... 378/108; 378/110

[58] Field of Search ..... 378/108, 110, 112, 99, 378/11, 16, 196, 151

[56] References Cited

U.S. PATENT DOCUMENTS

| | | | |
|---|---|---|---|
| 3,803,418 | 4/1974 | Holstrom | 378/196 |
| 3,894,235 | 7/1975 | Franke | 378/112 |
| 4,339,825 | 7/1982 | Barrett et al. | 378/174 |
| 4,403,337 | 9/1983 | Kleinman | 378/96 |
| 4,423,521 | 12/1983 | Haendle et al. | 378/99 |
| 4,454,606 | 6/1984 | Relihan | 378/97 |
| 4,475,224 | 10/1984 | Grassme | 378/108 |

*Primary Examiner*—Craig E. Church
*Assistant Examiner*—Charles F. Wieland
*Attorney, Agent, or Firm*—Fuller, House & Hohenfeldt

[57] ABSTRACT

An X-ray tube is movable between a minimum distance from an image receptor and a maximum distance. Signals are generated representative of the X-ray tube focal spot-to-image distance (SID), the peak kilovoltage (kVp) that is to be applied to the X-ray tube anode during a fluorographic exposure and the desired brightness of the X-ray image. The signals are processed in a manner that results in a control signal being developed that adjusts the X-ray tube filament current in a way that produces an X-ray tube current (mA) during the exposure which results in a constant limited X-ray dose rate at the X-ray beam entrance plane of a patient at any permissible kVp and SID setting and assures that the dose rate limit will not be exceeded at minimum permissible SID regardless of the selected kVp.

5 Claims, 8 Drawing Figures

VIDEO CAMERA
TV MONITOR
EXPOSURE CONTROL
(ABC) BRIGHTNESS CONTROL
ac
30cm
SOD
SID
+V
SID
FILAMENT CURRENT REGULATOR
Vc2
TRANSFER FUNCTION GENERATOR
A
B
C
D
kVp SIGNAL
mA COMMAND mA FOR 10R/MIN AT VARIOUS kVp & SIDS
30
26
22
18
14
10
6
2
60
70
80
90
100
110
120
kVp
113 cm SID
100.5 SID
85.4 SID
75 cm SID

AUTOMATIC X-RAY ENTRANCE DOSE COMPENSATION

BACKGROUND OF THE INVENTION

This invention pertains to diagnostic X-ray apparatus and, particularly, to means for limiting the X-ray entrance exposure rate for fluoroscopy.

During fluoroscopy of an anatomical region, the X-ray tube current is set low as compared with the current required for radiographing the same region and the exposure interval is usually quite long. Government regulations recommend that the X-ray exposure rate used in fluoroscopy should be as low as is consistent with the fluorscopic requirements and shall not exceed 10 Roentgens per minute (10R/min.), measured in air, at the position or plane where the X-ray beam enters the patient. The requirement applies to the use of X-ray intensifier equipment as well as conventional direct viewing fluoroscopic screens. In some X-ray apparatus, complying with these requirements results in the production of fluoroscopic images in which useful diagnostic information is obscured. In recently developed cardiovascular examination equipment, the patient is supported on an X-ray transmissive table top with the X-ray tube supported on one side and an image receptor, usually an electronic image intensifier, on the other side. In this equipment, the X-ray source or tube and intensifier are mounted for angulating jointly about the patient to obtain X-ray views of blood vessels at different perspectives. An example of such equipment is described in U.S. Pat. No. 4,339,825, dated July 13, 1982, and assigned to the assignee of the present application. This apparatus comprises an L-shaped arm (L-arm) that is rotatable about a vertical axis. A U-shaped arm (U-arm) is mounted to the upstanding leg of the L-arm for rotating or angulating about a horizontal axis. An X-ray image intensifier is mounted to the outboard end of one leg of the U-arm and an X-ray source, namely, an X-ray tube and collimator assembly is mounted to the outboard end of the other leg of the U-arm and the central ray emanating from the focal spot of the X-ray tube is directed toward the center of the image input plane of the image intensifier. A television camera is arranged for viewing the optical image produced by the image intensifier and for displaying the image on a television screen as is characteristic of modern fluoroscopy techniques. In this equipment, the X-ray tube is mounted for being moved toward and away from the patient who is supported in the beam path between the tube and the image receptor. Tube movement is made permissible so that more oblique angles of anatomical views can be obtained.

In L/U arm equipment the plane at which the X-ray beam enters the patient's body can, by way of example, be 30 cm. from the input plane of the image receptor. With the focal spot of the X-ray tube set at the usually desired minimum distance from the image intensifier input plane, it is possible to design the controls so that X-ray tube current will not be so great as to exceed the 10R/min. entrance dose rate. However where the flexibility of moving the X-ray tube toward and away from the patient is allowed, different conditions prevail. As the X-ray tube focal spot is moved closer to the patient, the permissible 10R/min. entrance dose can be exceeded and if it is moved farther from the standard minimum distance, entrance dose will decrease but so will the emergent X-ray exit dose. In the latter case, the reduced intensity of the emergent beam results in underexcitation of the image receptor and a consequent loss of diagnostic information in the fluoroscopic image.

In fluoroscopy, there are several variables that depend on the part of the anatomy or the density of the anatomy that is to be fluorographed. The peak kilovoltage (kVp) applied between the anode and cathode of the X-ray tube and the milliamperage (mA) or current flowing through the X-ray tube are selected on the basis of the density and thickness of the anatomical region of interest. As indicated already, the focal spot-to-image-distance (SID) also has a bearing on the intensity of the image produced in the receptor.

SUMMARY OF THE INVENTION

In accordance with the invention, means are provided for automatically adjusting the X-ray tube current so that the entrance dose to the patient will never exceed the maximum permissible dose for any user selected kVp and SID.

The matter of achieving this adjustment or compensation is complicated by the interaction of the selected tube factors. X-ray tube mA depends to some extent on the temperature of the cathode or filament of the X-ray tube. Electron current emission from the filament is related non-linearly to filament temperature and current flowing through the filament. With a low kVp in the available range of kilovoltages applied to the X-ray tube anode, emissivity and tube mA are fairly linearly related for a given filament temperature as is well known. As kVp is increased, however, the space charge about the filament which limits emissivity at lower kilovoltages is overcome and the relationship between kVp and mA becomes increasingly non-linear. Thus, entrance dose can vary with applied kVp even though the SID remains constant. Correspondingly, if the SID is reduced or increased, entrance dose will increase and decrease inversely.

In accordance with the invention, an entrance dose compensation system is provided for automatically varying the X-ray tube current relative to the SID or position of the tube unit at any selectable kVp to assure that the maximum allowable X-ray dosage is available for imaging regardless of the distance of the X-ray tube from its preferably minimum SID position.

The manner in which the foregoing and other more specific objectives of the invention are achieved, will be evident in the ensuing more detailed description of and illustrative embodiment of the invention which will now be described in detail in reference to the drawings.

DESCRIPTION OF THE DRAWINGS

FIG. 2 is an expanded block diagram of the transfer function generator depicted in FIG. 1;

DESCRIPTION OF A PREFERRED EMBODIMENT

Figure 1:
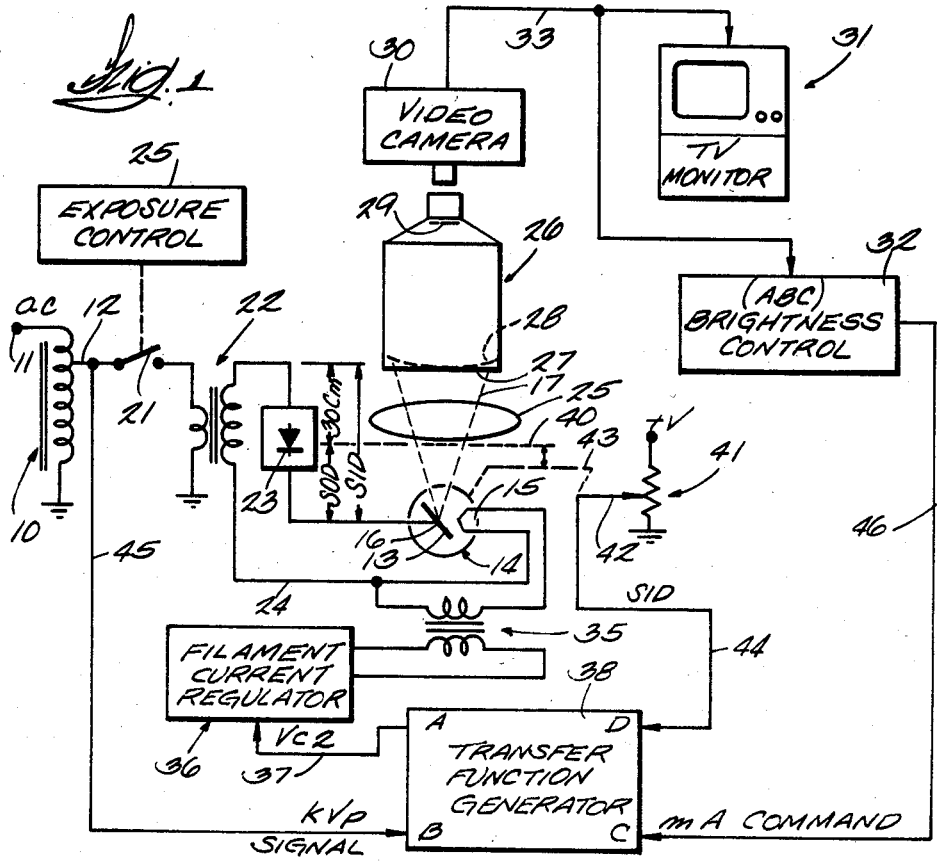
FIG. 1 is a generalized block diagram of an X-ray system incorporating the new automatic X-ray entrance dose compensation system.

A generalized partly schematic and partly block diagram of an X-ray system in which the new automatic entrance dose compensator is incorporated is depicted in FIG. 1.

In FIG. 1, the basic X-ray power supply comprises an autotransformer 10 having an input terminal 11 to which the power mains voltage is applied. A voltage adjusting device symbolized by a wiper 12 allows for tapping off a voltage that will be stepped up and rectified and applied to the anode 13 of an X-ray tube 14 whose cathode or filament is marked 15. The focal spot on which the focused electron beam from the filament impinges on the anode is marked 16. The boundaries of the X-ray beam emanating from focal spot 16 are illustrated by diverging dash-dot lines 17. The voltage tapped off of autotransformer 10 is delivered through a switch 21 through the primary winding of a step up transformer 22. A secondary winding of the step up transformer is in a series circuit including a full wave rectifier and filter 23, anode 13, filament 15 and return line 24. When switch 21 is closed, the high kilovoltage, typically in the range of 60 kVp to 120 kVp, is applied to the anode 13 to generate X-radiation. A fluorographic exposure is initiated by closing switch 21 and terminated by opening the switch. The circuitry for controlling operation of switch 21 is symbolized by the block marked 25 and labelled exposure control. As is typical, when the X-ray tube is being used for radiography, the exposure control is operative to time the selected duration of the exposure and close and open switch 21 accordingly. For fluorography, where the X-ray current or mA is lower and the exposure duration is usually longer than for radiography, the exposure duration is ordinarily longer than for a radiographic exposure but no longer than is necessary for the radiologist to obtain a preliminary or fluorographic view of an anatomical region of interest.

In FIG. 1, a patient undergoing a fluorographic examination is represented by the ellipse marked 25. The X-ray image receptor is an electronic intensifier generally designated by the numeral 26. It has an image input face or plane 27 immediately behind which there is a photo cathode represented by the dashed line 28. The image intensifier 26 may be the well known type that converts the input X-ray image to a bright minified optical image that appears on a phosphor disk 29 in the intensifier. The optical image is viewed by a video or television camera 30 that converts the optical image to analog video signals which are input to a television (TV) monitor 31 and an automatic brightness control (ABC) device 32 by way of a line 33. The function of the ABC will be discussed in more detail later.

Getting back to the X-ray tube power supply, one may see that the filament 15 is connected across the output terminals of the secondary winding of an isolating transformer 35 whose primary winding is supplied with an alternating current voltage from a filament current control that is symbolized by the block marked 36 in FIG. 1. The voltage applied to filament 15 through transformer 35 determines the current that will flow through the filament and, hence, its temperature and its electron emissivity. As is well known and was mentioned earlier, the electron beam current between the filament 15 and anode 13 of the X-ray tube depends mainly on filament temperature and its emissivity but will increase as the kVp applied to the anode 13 is increased and causes electron space charge around the filament, which limits emissivity at lower kVp, to be overcome. In other words, X-ray tube mA depends not only on filament temperature, but also on the kVp that is applied to the X-ray tube anode. The voltage applied to the primary winding of filament transformer 35 by filament current control device 36 depends on the magnitude of a compensated control signal that is supplied by way of a line 37 from terminal A of a transfer function generator that is represented by the block marked 38 in FIG. 1 and will be described in detail later.

In FIG. 1, the distance from the focal spot 16 on the X-ray tube target to the image input plane 27 of image receptor 26 is labelled SID. The distance from the focal spot to the plane 40 shown as a dashed line, at which the X-ray beam enters the patient, is designated the spot-to-object distance (SOD). In the depicted system, it is assumed that the X-ray tube 14 and, hence, focal spot 16 can be moved toward and away from the patient so the SOD is variable. However, in accordance with the invention, the X-ray tube mA is adjusted or compensated so that the X-ray input rate to the patient at the entrance plane 40 will remain constant such as 10R/min at any SOD within the permissible range of tube movement, and that 10R/min. will not be exceeded when the X-ray tube and its focal spot 16 are at the minimum obtainable distance from entrance plane 40 or, in other words, at minimum SOD. In the system shown in FIG. 1, it is assumed that the distance between the entrance plane 40 and the image intensifier input plane 27 is held constant, typically at 30 cm., as indicated in FIG. 1.

Referring further to FIG. 1, for the purpose of the invention, it is necessary to obtain a signal corresponding to the SID. This signal may be obtained by using a variable resistor 41 that has a wiper 42 which is driven along the resistor by having it coupled to the movable X-ray tube. The physical coupling is symbolized by the dashed line marked 43. The analog signal that is proportional to the SID is supplied by way of a line 44 to input terminal D of transfer function generator 38. How this signal is used will be described in more detail later in reference to FIG. 2 primarily.

Also required for two purposes, as will appear later, is a signal proportional to the kVp that has been selected by the user and applied to the anode 13 of the X-ray tube for a fluorographic exposure. The ac signal that is proportional to applied tube anode kVp is obtained by connecting a line 45 to the autotransformer output line 12. This ac signal is fed to input terminal B of the transfer function generator 38 and will be used in a manner that will be discussed in detail later.

The automatic brightness control, ABC 32, is of a known type that has an input for the video signal by way of line 33. The ABC is used in conventional fluorographic systems wherein the X-ray tube can never be moved so close to the patient as to violate the 10R/min entrance dose limitation as well as in the new dose compensating circuit. The function of the ABC in conventional and the presently described system is to maintain a displayed image of fixed brightness on the TV monitor 31 screen for any SID. In other words, if the X-ray tube is moved farther away from the beam entrance plane 40 of the patient and, of course, farther from the image intensifier, the brightness of the displayed image would decrease. Typically, the ABC will detect the reduction in the peak video signal or the average video signal and produce an mA command signal that is used to bring about a change in the X-ray tube filament current and, hence, an increase in the X-ray tube mA that will restore the brightness to the predetermined desired level. In FIG. 1, the mA command signal is provided by way of output line 46 of ABC 32 to input terminal C of the transfer function generator 38. The manner in which the mA command signal is used in the present invention will be elaborated later.

The ultimate entrance dose compensation signal produced by the invention is supplied to the filament current regulator 36 by way of line 37 from terminal A of transfer function generator 38. For the sake of elucidating the general concepts of the invention and/or obtaining the advantages of illustrating the manner in which the transfer function is executed, concrete numbers and values rather than relative values will be used in the ensuing detailed description, but it should be understood that these values are by way of illustration rather than limitation because the values will differ for different types of X-ray tubes and physical arrangement of the X-ray tube and receptors and the X-ray power supply. The values stated, however, are quite realistic for most present day fluorographic systems that use an X-ray image intensifier and television system. The compensated filament current control signal is further identified as $V_{C2}$ in FIG. 1.

One thing to do is to set the maximum tube mA which relates 10R/min patient entrance plane dose at the minimum SID, that is, when the tube is closest to the patient and to the receptor and to overcome the fact that as the tube is moved to a position in which it is normally used, the radiation input at the patient entrance plane is reduced non-linearly, that is, substantially in accordance with the square law for radiation. The tube mA must change to bring the dose rate at the entrance plane back up as SID is increased. It is the filament heating current that is adjusted to accomplish this. The magnitude of the filament current adjustment depends not only on SID but also in dependence on selected kVp since as kVp increases, space charge effect is overcome and the mA through the X-ray tube would increase even at a constant filament current. Thus, as higher kVp is applied to the X-ray tube anode, the filament temperature has to be lowered. That is one compensation function which must be accomplished just to maintain constant dose output for one SID setting. The other matter to consider is that as the SID is increased, it is necessary to raise the mA conducted by the X-ray tube back up again for any selected applied kVp in order to maintain a constant 10R/min at the patient entrance plane.

Figure 4:
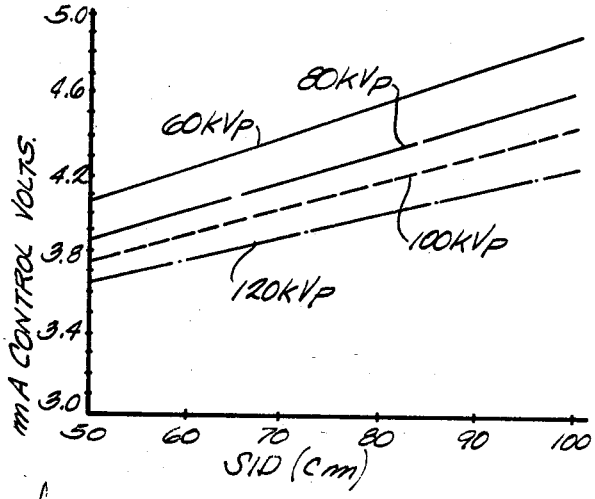
FIG. 4 is a graph for illustrating, in a hypothetical case, the relationship of the SID and the control voltage signal that is used to drive the filament current control for the range of peak kilovoltages (kVp) that are applied to the X-ray tube anode for obtaining a constant entrance dose such as 10R/min.

Referring to FIG. 4, the ordinates of the curves are expressed in terms of compensated control voltages, $V_{C2}$, which must be input to the filament current control for various SIDs and over a range of anode applied voltages from 60 kVp to 120 kVp. The control voltages indirectly correspond to the X-ray tube mA that is required to maintain 10R/min entrance dose at any permissible SID for a range of 60 to 120 kVp that is available for application to the anode of the X-ray tube. In any given system, the X-ray tube mA or corresponding control voltage $V_{C2}$ for any SID within the permissible range and for the kVp applied at the selected SID can be determined by locating a Roentgen or dose rate meter at the entrance input plane 40. Then a series of dose measurements are made during exposures with a constant kVp such as 60 kVp applied to the X-ray tube anode while SID is varied from exposure to exposure. The control voltages that are required to produce 10R/min. at the entrance plane 40 are recorded. The same procedure is carried out for other kVps such as 80, 100 and 120 kVp. The plot in FIG. 4 can be made from this data. Since at any applied kVp control voltage $V_{C2}$ varies linearly with SID as can be seen in FIG. 4, only the end points of the lines, that is, the control voltages at 50 and 100 cm. SID need to be determined. Note, however, that the slopes of the control voltage versus SID plots differ for different kVps. FIG. 4 reveals that at any given anode kVp, as SID increases, the filament current control voltage and the corresponding X-ray tube mA would have to be increased linearly relative to SID. It will also be evident from FIG. 4 that it is necessary to modify the tube mA at a particular rate depending upon the kVp that is being applied to the X-ray anode for the particular fluoroscopic examination.

Figure 3:
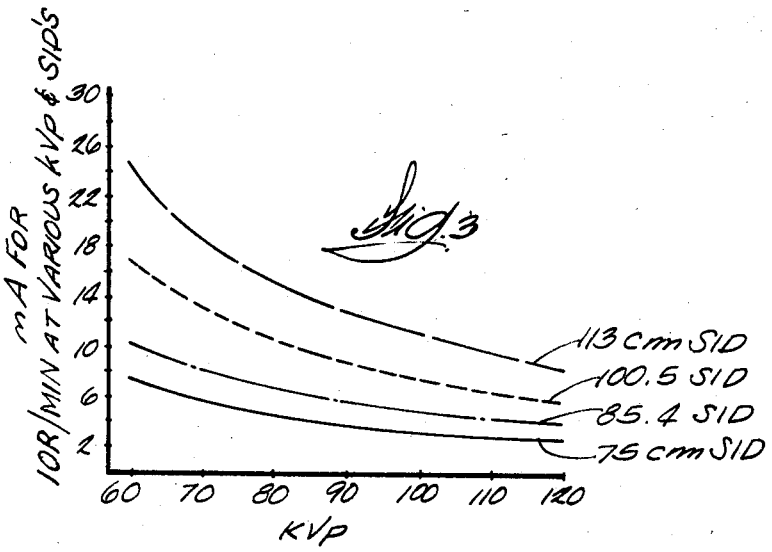
FIG. 3 is a graph for illustrating, in a hypothetical case, the interdependence of X-ray tube current (mA) and applied kVp at various focal spot to image distances (SIDs)
Figures 7, 8:
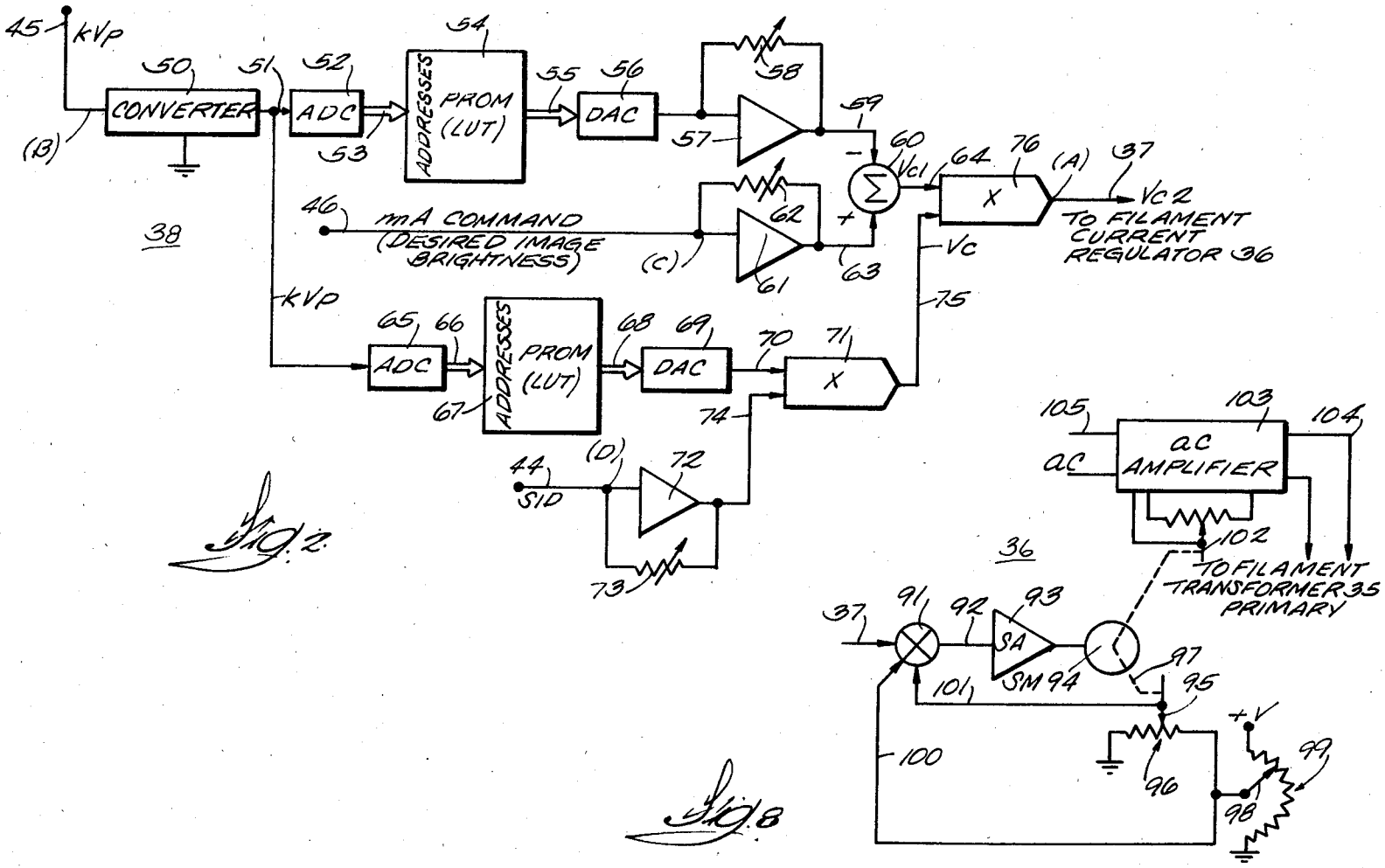
FIGS. 6 and 7 are graphs that are useful for describing operation of the transfer function generator depicted in FIG. 2.
FIG. 8 is a functional diagram of an X-ray tube filament current regulator that can be used in the FIG. 1 system.

FIG. 3 is another typical set of curves plotting X-ray tube mA (equivalent to filament control voltage) versus kVP to obtain a constant 10R/min. output for various SIDs. Actually, the FIG. 3 data is the same as the FIG. 4 data but the latter set of curves are plotted differently. FIG. 3 reveals that the control voltage $V_{C2}$ for the filament current control 36 can be changed in a linear fashion to maintain a constant X-ray dose at the entrance plane 40 as the SID changes. The curves in FIG. 4 provide the basis for the compensation circuit design, particularly the transfer function generator 38 which will now be described in greater detail in reference to FIG. 2. In the upper left corner of FIG. 2, the input on line 45 is an ac signal proportional to kVp, which signal is derived from the wiper 12 of the autotransformer 10 in FIG. 1. In FIG. 2, the ac signal corresponding to the kVp applied to the X-ray tube anode is converted to a corresponding dc signal in a converter represented by the block marked 50. The converter 50 steps down the ac voltage and rectifies it and produces a corresponding dc analog voltage that is output on line 51 which is also the input to an analog-to-digital converter (ADC) 52. The digital number appearing on the ADC output bus 53 corresponds in value to the kVp at which an X-ray tube is set to operate during the fluorographic procedure. The digital numbers on bus 53 are addresses to a look up table (LUT) which can be a programmable read-only memory (PROM) that is represented by the block marked 54. LUT 54 is programmed to compensate for the space charge effect between various selected kVps as has been demonstrated earlier. The transfer function of LUT 54 is illustrated in FIG. 7. It is a plot of the space charge change relative to kVp. Hence, the digital number corresponding to kVp addresses the corresponding space charge compensation factor that is stored at the address in LUT 54. The compensation data in the FIG. 2 illustrative circuit is in digital form and is output from LUT 54 on a bus 55 which is also the input to a digital-to-analog converter (DAC) 56. The analog output signal from DAC 56 is an input to an adjustable gain operational amplifier 57 whose gain can be adjusted with a variable resistor 58.

Providing an adjustable gain allows the system to be calibrated for any type of X-ray tube. The final signal corresponding to the space charge compensation factor for the selected kVp is fed from amplifier 57 by way of line 59 to one input of a summer 60.

During a fluorographic exposure the automatic brightness control, ABC 32, must bring about an X-ray tube current adjustment that depends on the SID as is evident from inspection of FIG. 4. As previously explained in reference to FIG. 1, ABC 32 puts out what is called an mA command to the transfer function generator 38. FIG. 2 shows that the mA command signal is an input to an operational amplifier 61 which also has variable feed-back resistor 62 for adjusting its gain. The analog mA command signal is input to amplifier 61 and the corresponding output on line 63 is another input to summer 60. The sum of the signals that are input to summer 60 is the output signal on line 64 and this signal, designated $V_{C1}$, would be a signal that could be used to drive the filament current regulator 36 to bring about adjustment of the X-ray tube filament current and, hence, the anode-filament current or mA that would maintain the predetermined desired brightness of the image displayed on TV monitor 31. This function, by itself, has been done before and it assures that the X-ray entrance dose at plane 40 will not exceed a predetermined value such as 10R/min but it does not assure that the entrance dose will remain constant when the SID is greater than the minimum permitted distance.

Figure 6:
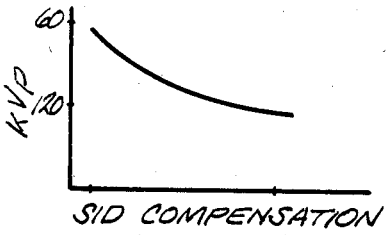
Figure 7:
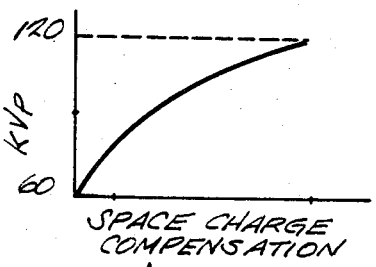

In FIG. 2 the additional compensation of the X-ray tube mA for SID is accomplished with a circuit having an ADC 65 as its input stage. The input to ADC 65 is the analog signal that is proportional to a selected kVp applied to the anode of the X-ray tube. The digital value output on bus 66 from ADC 65 is an address to LUT 67. The LUT 67 is programmed similar to LUT 54 but with a transfer function for SID compensation as illustrated in FIG. 6. Hence, the output from LUT 67 on bus 68 is also a digital number representative of the slope change relative to the kVp that is applied to the anode of the X-ray tube. This digital signal on bus 68 is converted to an analog signal in a DAC 69. The analog output signal is fed by way of a line 70 to one input of a multiplier 71. The other factor to take into consideration is that as the SID changes, increases for instance, from minimum, the X-ray tube mA must be raised for any given kVp in order to maintain a constant dose rate at entrance plane 40. The analog symbol representative of SID is applied by way of line 44 to input terminal D of the transfer function generator and the D terminal is the input to an operational amplifier 72 in FIG. 2. This amplifier has a variable resistor 73 in its feed-back circuit for setting the gain of the amplifier. The analog signal corresponding to SID is output from amplifier 72 by way of line 74 which is also an input to multiplier 71. The input 70 to multiplier 71 actually represents the slope required at each kVp as in FIG. 4 relative to the control voltage $V_{C2}$ that must be applied to the filament control 36 to produce the X-ray tube current required at a given SID to produce a constant entrance dose rate. The other input signal on line 74 to multiplier 71 is for relating the SID to the particular curve in FIG. 4. So, the output from multiplier 71 on line 75 is a signal that takes into account how the tube current has to be adjusted to get the desired X-ray output at a given SID and kVp. For convenience the signal is called $V_C$. It is input to another multiplier 76. Now the signal, $V_{C1}$, on input 64 to multiplier 76 is representative of the X-ray tube current that is required to yield a predetermined image brightness at a given kVp. The multiplier 76 multiplies $V_{C1}$ by VC or a signal that relates SID to kVp. The result of the multiplication is $V_{C2}$ which is output on line 37 in FIG. 2 to the filament current regulator 36 as shown in FIG. 1.

Figure 5:
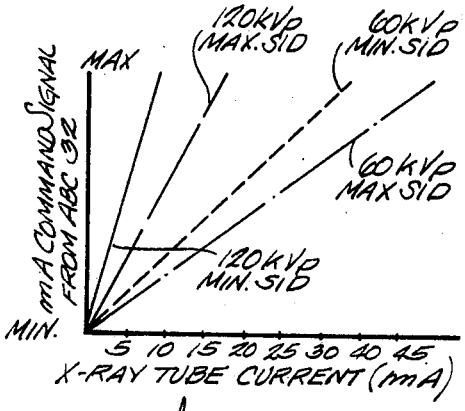
FIG. 5 is a graph for showing how X-ray tube mA varies with control voltage from the automatic brightness control (ABC) depicted in FIG. 1 for various SIDs at various kVp to obtain 10R/min. X-ray entrance dose.

By referring to FIG. 5, one may see that the mA command signal from the ABC 32 will cause an X-ray tube current or mA of a particular value, represented along the abscissa which corresponds to $V_{C1}$. One may see that at 120 kVp and minimum SID, the X-ray tube current needs to be relatively low. At the same kVp and maximum SID, of course, the tube current must be increased to provide 10R/min. at entrance plane 40. At the lower end of the kVp range or 60 kVp the X-ray tube current required at the maximum SID is substantially greater than that required at the minimum SID.

The filament current regulator 36 may take many forms. It is symbolized functionally in FIG. 8. The control voltage, $V_{C2}$, is input to the filament current regulator correspondingly with FIG. 1. In FIG. 8, the control voltage signal on line 37 is one input to a summer 91 whose output line 92 feeds a servosystem amplifier (SA) 93. The output of the amplifier is the drive signal for a servomotor (SM) 94. As symbolized by the dashed line 97, servomotor 94 drives the wiper 95 of a potentiometer 96. The drive is represented by the dashed line 97. The potentiometer resistor is tied to a reference voltage source such as potentiometer 99. Setting of potentiometer 99 sets the filament current for producing the tube mA at which fluorography is desired. The reference signal taken off of the wiper 98 of potentiometer 99 constitutes one input, by way of line 100 to summer 91. Another input 101 of the summer is a voltage derived from wiper 95. If the approximate desired X-ray tube current is set by adjusting wiper 98 of potentiometer 99, there will first be an error signal constituting the difference between the voltages on wipers 95 and 98 and, hence, the voltage difference between the inputs 100 and 101 of summer 91. This error signal is amplified and energizes the servomotor to run until wiper 95 is moved to a position where the error signal is reduced to zero and the servomotor stops. Now, when the system is initialized making a fluorographic exposure, the compensated current control signal, $V_{C2}$, on line 37, is another input to summer 91. The compensated current control signal creates an unbalance or error signal in the output line 92 of the summer and servomotor 94 drives until the error signal is nulled by the opposite signal developed on driven potentiometer wiper 95. Servomotor 94 also drives a potentiometer wiper 102 which regulates the output voltage from an ac amplifier circuit represented by the block marked 103. The output lines 104 are connected to the primary winding of filament transformer 35 in FIG. 1. The ac power input lines to amplifier 103 are marked 105. The filament can be energized when the X-ray system is initialized for making a fluorographic-exposure but no X-rays are emitted until the high voltage is applied to the X-ray tube anode by closing switch 21 in FIG. 1.

The automatic X-ray entrance dose compensator has been implemented in the manner described and provides a basis for demonstrating the functions or parameters required to compensate X-ray tube mA for varying SIDs and accounting for the non-linear relationship between applied kVp and filament emissivity while maintaining a constant displayed image brightness and a constant X-ray patient entrance dose at any SID setting. It should be understood, however, that the invention can be implemented in other ways such as by using a microprocessor, not shown, in which case the LUTs 54 and 67 would be eliminated, among other things. If a processor is used, the algorithm which is actually executed in the compensator described above would be executed under software control. In such case, the SID, kVp and desired mA parameters could be generated in the manner described above in which case the algorithm calculates a final filament current control voltage $V_{C2}$.

We claim:

1. An X-ray apparatus comprising:

X-ray image receptor means having an X-ray image input plane; an X-ray tube having a filament and an anode on which a focal spot is produced when current (mA) flows through the tube, said tube being movable for varying the focal spot-to-image plane distance (SID) between a minimum and a maximum and being operative to project an X-ray beam from said spot through the X-ray entrance plane of the examination body to the receptor image input plane; an X-ray power supply and control means for selectively varying the peak kilovoltage (kVp) applied to the anode of said tube for making an X-ray exposure; and, the improvement for maintaining a constant permissible maximum X-ray dose rate (R/min) at said entrance plane during fluoroscopy for various values of kVp and SID, comprising:

means for adjusting the X-ray tube filament current at a predetermined first rate as SID is changed and concurrently modifying said first rate as kVp is changed such that the X-ray tube current will result in an R/min at said entrance plane that will not exceed said maximum permissible R/min at minimum SID and will remain constant up to substantially maximum SID.

2. An X-ray apparatus comprising:

X-ray image receptor means having an X-ray image input plane and an optical image output plane; an X-ray tube having a filament and an anode on which a focal spot is produced when current (mA) flows through the tube, said tube being movable for varying the focal spot-to-image plane distance (SID) between a minimum and a maximum and being operative to project an X-ray beam from said spot through the X-ray entrance plane of the examination body to the receptor image input plane; an X-ray power supply and control means for selectively varying the peak kilovoltage (kVp) applied to the anode of said tube for making an X-ray exposure; and, the improvement for maintaining a constant permissible maximum X-ray dose rate (R/min) at said entrance plane during fluoroscopy for various values of kVP and SID, comprising:

automatic brightness control (ABC) means for adjusting the X-ray tube filament current during an X-ray exposure to maintain the optical output image of said receptor means at a constant predetermined brightness level, means operative concurrently with said ABC means for simultaneously adjusting said filament current at a predetermined first rate as SID is changed and concurrently modifying said first rate as kVp is changed such that the X-ray ray tube current (mA) corresponding to the filament current will result in an R/min at said entrance plane that will not exceed said R/min at said entrance plane at minimum SID and will remain constant up to substantially maximum SID.

3. An X-ray apparatus comprising:

X-ray image receptor means having an X-ray image input plane; an X-ray tube having a filament and an anode on which a focal spot is produced when current (mA) flows through the tube, said tube being movable for varying the focal spot-to-image plane distance (SID) between a minimum and a maximum and being operative to project an X-ray beam from said spot through the X-ray entrance plane of the examination body to the receptor image input plane; an X-ray power supply and control means for selectively varying the peak kilovoltage (kVp) applied to the anode of said tube for making an X-ray exposure; and, the improvement for maintaining a constant permissible maximum ray dose rate R/min at said entrance plane during fluoroscopy for various values of kVp and SID, comprising:

current regulator means operative to vary the X-ray tube filament current in response to a variable control signal, automatic brightness control (ABC) means for generating a command signal corresponding to the desired brightness of the optical output image of said receptor means, means for generating a kVp signal corresponding to the selected kVP that is to be applied to said anode during the X-ray exposure, means for providing an SID signal corresponding to the selected SID for said exposure, means for modifying said command signal in dependence on the magnitude of said kVp signal to produce one signal, means for modifying said SID signal in dependence on the magnitude of said kVp signal to produce another signal, and means for combining said one and said another signal to yield said variable control signal for causing said filament current regulator means to vary the filament current that will result in an X-ray tube current (mA) producing said maximum permissible R/min at said entrance plane for the selected SID and kVp.

4. An X-ray apparatus including:

X-ray image receptor means having an optical image output plane; an X-ray tube having a filament and an anode, said tube being movable from a minimum to a maximum distance from said receptor and being operative to project an X-ray beam from the focal spot on its anode through a space containing the X-ray entrance plane for an examination body and to the image input plane of the receptor; a power supply for applying a selected kilovoltage (kVp) to said anode relative to said filament to make an X-ray exposure; and the improvement for maintaining a predetermined X-ray dose rate at said entrance plane during fluoroscopy for any selectable applied kVp and focal spot-to-image plane distance (SID) combination, comprising:

current regulator means responsive to a control signal by varying the X-ray tube filament current, automatic brightness control means for generating first data representative of the desired brightness of the optical output image of said image receptor means, means for generating second data representative of the kVp that is to be applied to said anode during the X-ray exposure, means for generating third data representative of said SID, means for modifying the first data and the third data by an amount depending on the value of said data representative of said kVp, and means for combining the results of said modifications and for producing said control signal to which said regulator responds by varying the X-ray tube filament current to the extent required to provide said predetermined X-ray dose rate at said entrance plane for the selected combination of applied kVP and SID.

5. An X-ray apparatus including X-ray image receptor means; an X-ray tube having a filament and an anode, said tube being movable from a minimum to a maximum distance from said receptor and being operative to project an X-ray beam from the focal spot on said anode through a space containing the X-ray entrance plane for an examination body and to the image input plane of the receptor; a power supply for applying a selected kilovoltage (kV) to said anode relative to said filament to make a flouroscopic exposure; and the improvement for a predetermined X-ray dose rate at said entrance plane during fluorosocopy for any selectable applied kVp and focal spot-to-image plane distance (SID) combination, comprising:

current regulator means responding to the magnitude of a control signal ($V_{C2}$) by varying the filament current and, hence, the temperature of said filament to establish the current (mA) that will flow through the tube when said kVp is applied, means for providing a first signal whose value corresponds to the selected kVp that is to be applied to said anode furing an X-ray exposure, automatic brightness control (ABC) means operative to provide a second signal whose value corresponds to the desired brightness of the optical output image of said receptor means, means for providing a third signal whose value corresponds to the set SID, means for summing said first signal and second signal to produce a first result and for multiplying said first signal and said third signal to produce a second result and for multiplying said results to yield said control signal to which said current regulator means responds.

* * * * *